United States Patent [19]

Johnson

[11] Patent Number: 4,903,747

[45] Date of Patent: Feb. 27, 1990

[54] LOCK FOR BI-FOLD DOORS AND THE LIKE

[76] Inventor: Robert U. Johnson, 1707 N. Harrison St., Fort Wayne, Ind. 46808

[21] Appl. No.: 387,508

[22] Filed: Jul. 28, 1989

[51] Int. Cl.[4] ..... E06B 3/48; E05B 15/02

[52] U.S. Cl. ..... 160/117; 70/DIG. 65; 292/340; 292/DIG. 55

[58] Field of Search ..... 70/450, DIG. 65; 292/340, DIG. 21, DIG. 39, DIG. 40, DIG. 55; 160/199, 213, 117, 119

[56] References Cited

U.S. PATENT DOCUMENTS

| | | | |
|---|---|---|---|
| 1,373,678 | 4/1921 | Siemer | 292/340 |
| 1,472,512 | 10/1923 | Carlson | 292/340 |
| 1,811,313 | 6/1931 | Fildes | 160/119 X |
| 4,029,349 | 6/1977 | Sweda et al. | 292/DIG. 55 X |
| 4,722,204 | 2/1988 | Foshee | 70/360 X |

*Primary Examiner*—Lloyd A. Gall

*Attorney, Agent, or Firm*—Pearne, Gordon, McCoy & Granger

[57] ABSTRACT

A pair of bi-fold assemblies includes a lock for securing the assemblies in a closed position. The lock includes a latch bolt mounted on a panel of a first assembly, and a base plate of a second assembly includes an extending portion with an opening to receive the latch bolt.

3 Claims, 3 Drawing Sheets

LOCK FOR BI-FOLD DOORS AND THE LIKE

BACKGROUND OF THE INVENTION

This invention relates to closet doors, passage doors or window shutters and particularly those which have a bi-fold construction. A bi-fold assembly comprises two panels hinged together with one panel hinged to a door or window jamb. The two panels of each assembly collapse on a set of hinges and fold toward one another when the assembly is opened. As such, when both panels form a common planar surface the assembly is in its closed position. Two bi-fold assemblies together are commonly used as closet or passage doors or window shutters.

When bi-fold assemblies are used as doors or as window shutters it is often desirable to positively lock two bi-fold assemblies together when they're closed. This provides security against intruders. If the bi-fold assemblies are used as closet doors a positive locking means will deter any unauthorized access to articles within the closet. The same holds true for shutters. If a window contains two bi-fold assemblies with a locking means intruders will be inhibited from gaining entrance through the window.

Present methods of securing two bi-fold assemblies in their closed position are inadequate because they don't provide a means for positively locking the assemblies together. A common method is a hook and an eyelet. A hook is screwed into the edge of one assembly and an eyelet screwed into the edge of the opposing assembly While this arrangement keeps the assemblies closed, it doesn't prevent their unauthorized opening.

Another common method to secure bi-fold assemblies in a closed position is a biasing means such as a spring. The bi-fold assemblies aren't hooked together but rather each is individually secured in place in its closed position. Spring systems however do not provide a positive lock. Other techniques are available for positively locking two bi-fold assemblies together; however, these allow ready access to the latch with a cutting tool thereby permitting an intruder to defeat the lock.

The locking means of the present invention overcomes the difficulties described above and affords other features and advantages heretofore not available.

SUMMARY OF THE INVENTION

It is an object of the present invention to positively lock two bi-fold assemblies in their closed position.

Another object is to limit the chores for defeating the lock with a cutting tool. These and other objects are achieved with the novel lock construction of the present invention which is uniquely adapted for use in bi-fold assemblies.

Each bi-fold assembly comprises an end panel and an inner panel. The end panel has a jamb stile and a hinge stile with the jamb stile hinged to a door or window jamb. The inner panel has a hinge stile and a lock stile. The inner panel and the end panel are hinged together at their respective hinge stiles. In ordinary usage a closet or window will have two bi-fold assemblies each hinged to opposing door or window jambs at their respective jamb stiles. When the bi-fold assemblies are closed, the edge of the lock stile of one inner panel abuts the edge of the lock stile of the opposing inner panel.

The lock assembly of the invention comprises a catch, a latch assembly and a striker plate. The catch is secured to the inner surface of the lock stile of one inner panel. The catch is shaped like a "T" having a leg and a locator tab. With the catch so attached and the two bi-fold assemblies closed, the locator tab affixed to the end of the leg points perpendicularly away from the lock stile and toward the lock stile of the opposing inner panel. The locator tab helps to align the two bi-fold assemblies when they are closed. It also limits accessibility to the catch base with a cutting tool from outside the bi-fold assemblies.

The striker plate is recessed in the abutting edge of the lock stile of the opposing inner panel. The striker plate is substantially rectangular having a rectangular slot near its center. When the bi-fold assemblies are closed the locator tab fits into the slot within the striker plate and the base of the catch lays flush against the inner surface of the opposing inner panel. Once the locator tab is received by the striker plate the latch assembly engages an aperture within the base of the catch. This engagement is accomplished by a lock bolt which is moveable axially between a retracted position and an extended position and housed in a locking cylinder. In its extended position the lock bolt engages the aperture within the base of the catch. The latch assembly is mounted within the lock stile of the opposing inner panel.

Once the lock bolt engages the aperture in the base of the catch the bi-fold assemblies are prevented from being opened until the lock bolt is retracted. Additionally, the lock bolt can be locked in its extended position with a key that activates the locking cylinder. Thus, the bi-fold assemblies are positively locked and protected from tampering.

DESCRIPTION OF THE PREFERRED EMBODIMENT

Figure 1:
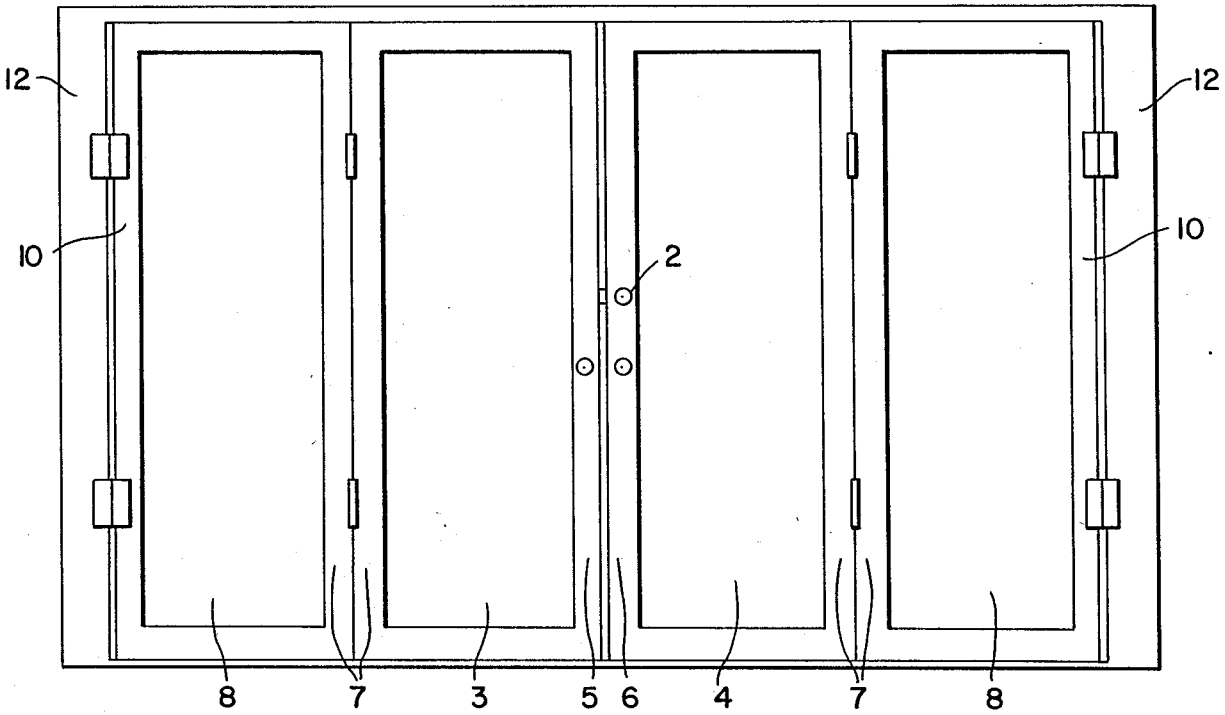
FIG. 1 is a front elevation showing a set of bi-fold door assemblies with a proximal location of an embodiment of the invention.

Referring more particularly to the drawings and initially to FIG. 1, there is shown a set of bi-fold assemblies and a possible location for a lock assembly of the invention. Each bi-fold assembly comprises two panels: an inner panel 3, 4 having a lock stile 5, 6 respectively and a hinge stile 7, and an end panel 8 having a jamb stile 10 and a hinge stile 7. The end panels 8 are hinged to a door or window jamb 12 at their respective jamb stiles 10. The inner panels 3, 4 are hinged to the end panels 8 at their respective hinge stiles 7. Arrangements of this type are often used for closet doors or doors leading from a patio or balcony to the interior of a dwelling. They are also commonly used as window shutters.

Figure 2:
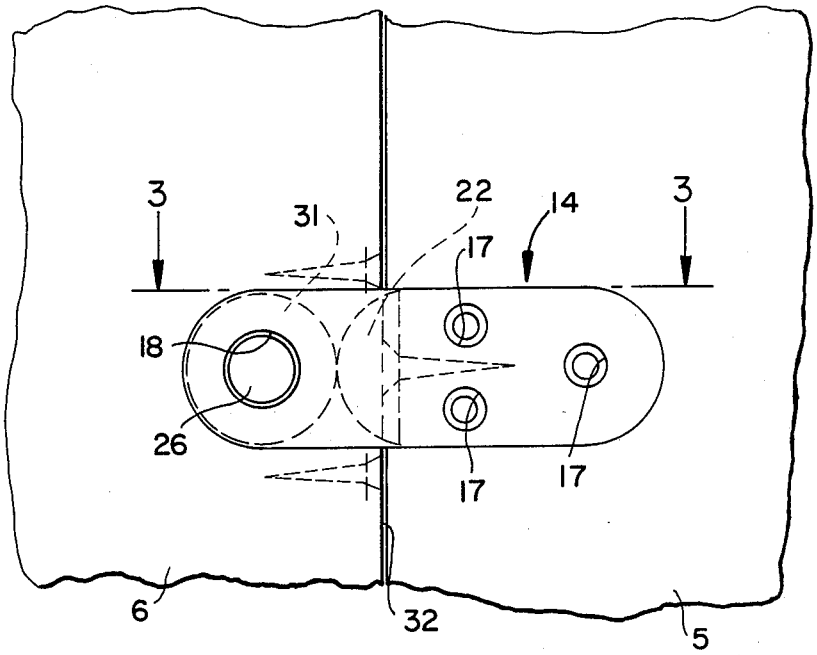
FIG. 2 is a fragmentary front elevation on an enlarged scale of an embodiment of the invention located within the lock stiles of two inner panels.
Figure 3:
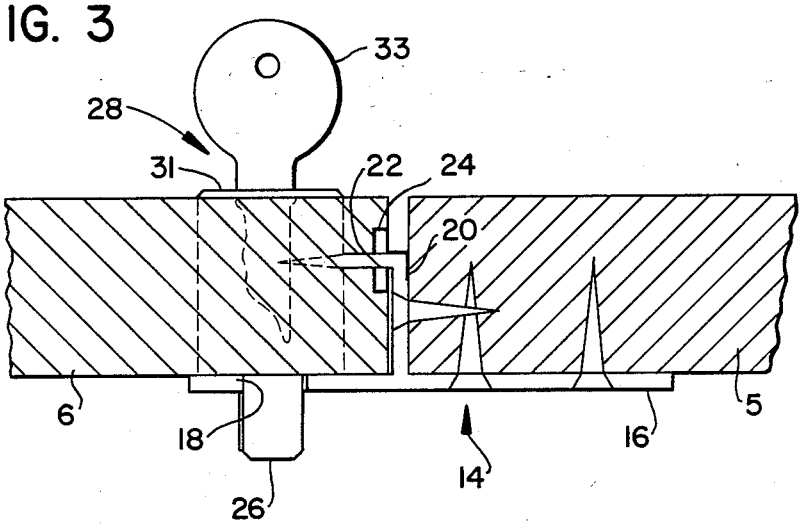
FIG. 3 is a fragmentary sectional view taken on the line 3—3 of FIG. 2.

Referring to FIGS. 2 and 3, there is shown a catch 14 which includes a base 16 having a plurality of apertures 17 and 18, a leg 20, and a locator tab 22. The base 16 is substantially rectangular with rounded corners. The leg 20 has an aperture 19 and is perpendicular to the base 16, dividing the base 16 into two segments. The aperture 19 is used for fastening the catch 14 to a bi-fold assembly. One segment of the base 16 has a plurality of apertures 17 for fastening the catch 14 to a bi-fold assembly.

The other segment of the base 16 defines the aperture 18. The aperture 18 is adapted to receive a lock bolt 26 to positively lock the bi-fold assemblies in a closed position. The locator tab 22 is perpendicular to the leg 20 and faces toward the opposite panel 3. The locator tab 22 is adapted to be inserted into a rectangular slot 23 when the bi-fold assemblies are closed. It also prevents access to the base 16 from outside the bi-fold assemblies with a cutting tool thus making it difficult to defeat the lock.

Figure 4:
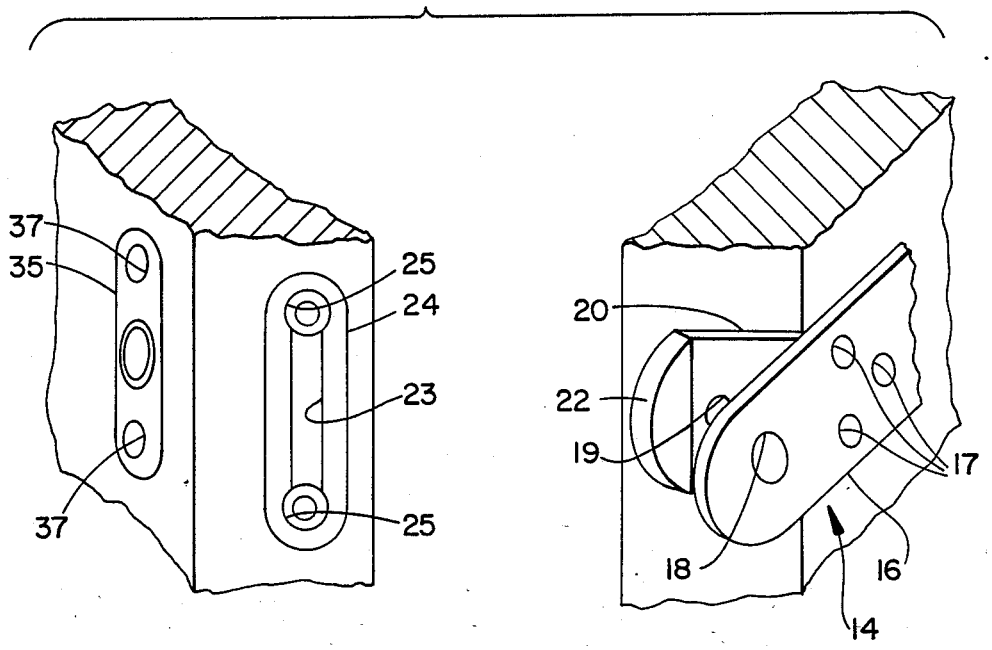
FIG. 4 is an perspective view of the component parts of the invention showing the striker plate as mounted in the lock stile of one inner panel and the catch as mounted in the lock stile of the other inner panel.

FIG. 4 shows a striker plate 24 having a rectangular slot 23 and a plurality of apertures 25. The apertures 25 receives screws to fasten the striker plate 24 to a bi-fold assembly. The rectangular slot 23 is adapted to receive the locator tab 22 when the door assemblies are closed.

FIGS. 3 and 4 also show the latch assembly 28 comprised of a lock bolt 26, a lock cylinder 31 and a latching base 35. The latching base 35 has a plurality of apertures 37 that receive screws used to mount the latching assembly 28 in a bi-fold assembly. The locking cylinder 31 has a key 33 which locks the lock bolt 26 once in its extended position and engaged with aperture 18.

FIG. 1 shows the lock assembly of the invention located at a point about 32 inches from the bottom of the panels; however, the lock may be placed at other points vertically along the lock stile 5 or 6 as desired.

Referring to FIG. 2 the catch 14 is secured to the inner surface of the lock stile 5 of one inner panel 3. The catch 14 is positioned so that the leg 20 is secured in the edge 32 of the lock stile 5 and the locator tab 22 points away from the lock stile 5 toward the lock stile 6 of the opposing inner panel 4. The striker plate 24 is recessed in the edge 32 of the lock stile 6 of the opposing inner panel 4 so that when the bi-fold assemblies are closed the striker plate 24 will receive the locator tab 22. In a variation of this positioning the locator tab 22 engages the outer surface of the lock stile 6 of the opposing inner panel 4 rather than the rectangular slot 23 of the striker plate 24. This embodiment eliminates the need for a striker plate 24.

Once the catch 14 and the striker plate 24 are properly positioned and the bi-fold assemblies are closed the lock bolt 26 is inserted in the aperture 18 to positively lock the bi-fold assemblies in their closed position (FIGS. 2 and 3). The lock bolt 26 is moveable axially between a retracted position and an extended position.

In the preferred embodiment the lock bolt 26 is part of an assembly that also includes a locking cylinder 31 operated by a key 33. When the bi-fold assemblies are closed and the lock bolt 26 is extended it engages the aperture 18. After the lock bolt 26 engages aperture 18 the locking cylinder 31 can be activated by the key 33 thereby locking the lock bolt 26 in place. In this position the bi-fold assemblies cannot be opened without the key. The lock bolt 26 may be retracted with key 33 by unlocking the locking cylinder 31 and then disengaging the lock bolt 26 from the catch base 16. As such, the bi-fold assemblies may be opened.

While the invention has been shown and described with reference to a preferred embodiment thereof this is for the purpose of illustration rather than limitation and other variations and modifications of the specific construction herein shown and described will be apparent to those skilled in the art all within the spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. In a pair of bi-fold assemblies, each comprising an end panel and an inner panel having a hinge stile and a lock stile, each end panel being hinged to a frame jamb and each inner panel being hinged to an end panel, wherein the inner panel of one bi-fold assembly and the inner panel of a second bi-fold assembly abut at their respective lock stiles when the pairs are closed, a lock comprising:

a latch assembly mounted in the lock stile of a first inner panel and including a latch bolt adapted for linear movement perpendicular to the plane of the respective panel between a retracted position and a locking position extending beyond the interior surface of the first inner panel, and a catch assembly including a base plate secured to the interior surface of the lock stile of the second inner panel and adapted to extend across the interior surface of said lock stile of the first inner panel, when said bi-fold assemblies are in their closed position, the extending portion defining an opening adapted to receive said latch bolt when in its extended position, and a leg extending perpendicular to said base plate and adapted to be positioned between the abutting lock stile edges of said inner panels, said leg having a locator tab extending perpendicular to said leg and adapted to engage the abutting lock stile of the first inner panel to resist relative movement of the inner panels out of coplanar relationship when said bi-fold assemblies are in their closed position.

2. A lock as defined in claim 1, wherein said latch assembly includes a lock cylinder and a key for operating said cylinder to move said latch bolt between its extended and retracted positions.

3. A lock as defined in claim 1, further including a striker plate mounted on the abutting edge of the lock stile of said first inner panel and having a vertical slot formed therein, said slot being adapted to snugly receive said locator tab to retain said inner panels in coplanar relationship when said assemblies are in their closed position.

* * * * *